United States Patent [19]

Richards et al.

[11] Patent Number: 4,687,060

[45] Date of Patent: Aug. 18, 1987

[54] PRODUCTION AND GROUT LINER FOR METHANE DRAINAGE IN SUBTERRANEAN BOREHOLES AND METHOD

[75] Inventors: Walter L. Richards, Huntington Beach; Roger L. Henderson, Bluefield, W. Va.; George N. Aul, Richlands, Va.; Barry W. Pauley, West Blocton, Ala.

[73] Assignee: Methane Drainage Ventures, Placentia, Calif.

[21] Appl. No.: 874,075

[22] Filed: Jun. 13, 1986

[51] Int. Cl.[4] ..... E21B 33/13

[52] U.S. Cl. ..... 166/285; 166/292; 175/62; 299/12; 405/268

[58] Field of Search ..... 166/50, 233, 235, 285, 166/289, 290, 292; 405/266, 268, 269; 299/2, 12; 175/62

[56] References Cited

U.S. PATENT DOCUMENTS

| | | | |
|---|---|---|---|
| 3,177,955 | 4/1965 | Allen et al. | 166/50 |
| 4,183,407 | 1/1980 | Knopik | 166/50 |
| 4,300,631 | 11/1981 | Sainato et al. | 166/187 |
| 4,303,274 | 12/1981 | Thakur | 299/12 |
| 4,321,967 | 3/1982 | Koppe et al. | 299/12 |

FOREIGN PATENT DOCUMENTS

| | | | |
|---|---|---|---|
| 1182190 | 11/1964 | Fed. Rep. of Germany | 299/12 |
| 0739246 | 6/1980 | U.S.S.R. | 299/12 |

*Primary Examiner*—Stephen J. Novosad
*Assistant Examiner*—Terry Lee Melius
*Attorney, Agent, or Firm*—Walter A. Hackler

[57] ABSTRACT

A process is provided for sealing a degas hole in a coal seam prior to mining of the coal therein which includes the steps of inserting a perforated liner into the degas hole substantially the entire length thereof and pumping grout down the center of the perforated liner to the end of the degas hole. As the end of the degas hole is filled with grout, pressure is increased to force grout through the perforations in the liner to fill the degas hole along the entire length thereof. The perforated liner is also useful in the election of methane gas prior to sealing of the degas hole and further ensures a clear path through the degas hole so that sloughing, or caving, of the degas hole prior to grouting does not interfere with the complete sealing of the degas hole.

6 Claims, 5 Drawing Figures

PRODUCTION AND GROUT LINER FOR METHANE DRAINAGE IN SUBTERRANEAN BOREHOLES AND METHOD

The present invention is directed to the draining of methane gas from subterranean coal seams utilizing degas holes and to the sealing of such degas holes when the mining cycle approaches the degas hole in order to prevent undesirable venting of methane gas into the working area of the coal mine as it passes through the degas hole. More particularly, the present invention is directed to a combination gas production liner and degas hole grout sealer useful in combination with mining operations for draining methane gas from coal seams prior to mining, while at the same time preventing such premining degas operations from introducing unwanted methane gas into the working area as mining of the coal progresses. An important feature of the present invention is a process for sealing a degas hole in a coal seam prior to mining of the coal therein.

Most, if not all, coal mining operations are concerned with the presence of methane gas which is adsorbed in the coal structure. It is well known that as coal is removed from a coal seam the methane gas adsorption equilibrium is disturbed, thereby releasing previously adsorbed gas into the microfractures of the coal and thereafter into the working area.

It is well known that the drilling of horizontal boreholes, or degas holes, is an effective method of draining methane gas in advance of mining coal seams. This method has proved more effective than drilling vertical holes through the coal seams because the horizontal degas holes expose a far greater area for release of methane gas within the coal seams.

A significant problem introduced by horizontal borehole method is the fact that the degas holes provide an immediate outlet for gases remaining in the coal seam as mining progresses therepast.

In other words, as the mining or working areas intercept previously drilled horizontal degas holes, the working areas are "gassed off", because the hole allows methane gases to freely flow into the working area.

In order to prevent this "gassing" of working areas, it is preferred that the previously drilled degas holes are sealed in advance of mining operations. Since degas holes may be drilled horizontally within a coal seam for distances up to 3000 feet or more, the sealing of these holes present a significant problem. This problem is not addressed by the vertical holes where the use of gravity facilitates the introduction of a grouting material into the hole to fill the hole with a solid material to prevent gas flow therethrough. Heretofore, any introduction of a grouting material into a horizontal hole of lengths up to 3000 feet or more has not been achieved because of voids created by the pumping of grout material into the horizontal degas hole.

Many coal seams may be described as having caving, or sloughing, characteristics. As the name implies caving, or sloughing, coal seams are those in which the integrity of the coal formation therein is insufficient to maintain a consistent degas hole during the drilling operation or thereafter for the collection of methane gas. Experience has shown that sloughing during drilling can be flushed out, but that the sloughing after completion has a potential of reducing methane gas production by as much as 50 percent, or more, of the steady flow rate from the degas hole.

Significantly, such sloughing, or caving in, of degas hole walls not only restricts the flow of methane gas during the productive cycle of the degas hole, but also prevents the degas hole from being properly sealed, so that mining can safely intercept the hole. It should be apparent that such blockages, or partial blockages of the degas hole caused by sloughing, prevents grouting material from being properly introduced throughout the entire degas hole in order to prevent the gas flow therefrom when it is intercepted by mining of the coal seam. That is, conventional grouting of a degas hole by forcing grout down the hole does not entirely fill the degas hole because the grouting material cannot be effectively forced past blockages in the hole caused by sloughing.

Hence, there is a need for an operational system, or process, for effectively draining methane gas from generally horizontal degas holes in subterranean seams and thereafter sealing such holes to enable subsequent mining of the coal in the coal seams without interference from excess methane gas leaking thereinto.

The present invention provides for a process for satisfying these needs along with apparatus useful in the process.

SUMMARY OF THE INVENTION

A process for sealing a degas hole in a coal seam prior to mining of the coal therein in accordance with the present invention includes the steps of inserting a perforated liner into a degas hole substantially the entire length thereof and pumping a grout down center of the perforated liner to the end of the degas hole.

The end of the degas hole is filled with grout as it is pumped down the center of the perforated liner until it is filled to the end of the perforated liner. At that time, pressure may be increased to force the grout through the perforations in the liner to fill the degas hole along the length thereof. This process continues until the entire degas hole is filled with grout. Thereafter, the grout is allowed to set, thereby sealing the degas hole and ensuring that insignificant amounts of methane gas leak therefrom when mining operations intercept the hole during removal of the coal within the coal seam.

The use of the perforated liner enables grout to be introduced along the entire length of the degas hole. In addition, the insertion of the perforated liner into the degas hole overcomes any obstacles caused by sloughing of the degas hole, which otherwise may prevent grout from being introduced into the distal regions of the hole.

The process of insertion includes the assembly of a casing shoe on a drill pipe, thereafter placing the perforated liner inside the drill pipe and inserting the drill pipe into the degas hole with the perforated liner therein. Withdrawal of the drill pipe from the degas hole with the drill pipe and casing shoe passing over the perforated liner leaves the perforated liner intact within the hole for subsequent introduction on grout thereinto.

More particularly, the casing shoe and a portion of the drill pipe is inserted in the borehole in advance of the liner in order to protect the liner from damage during insertion. Additionally, the casing shoe, drill pipe and liner therein may be rotated during insertion in order for the casing shoe to cut through obstructions therein. Periodically, the insertion of the casing shoe, drill pipe and liner is stopped, and the degas hole is flushed with water in order to remove any cuttings or obstacles removed by the casing shoe as it is rotated during the insertion.

It should be appreciated that a generally horizontal degas hole will follow the undulations of the coal seam within the ground for distances up to 3000 feet or more. Hence, the liner is not inserted into a straight aligned hole but, rather, must sinusoidally weave and turn gradual corners as it is inserted into the drill hole. Because of these bends, it is impractical to insert the liner by itself for long distances, such as up to 3000 feet or more, and the insertion of the liner within the drill pipe solves this problem.

The perforations, or holes, in the liner are useful for the production of methane gas after its introduction into the hole. Hence, the liner of the present invention is useful both as a production liner and a grout sealer for methane drainage operations in subterranean boreholes and comprises a pipe formed from a non-sparking material and means defining a plurality of openings through a wall of the pipe for enabling methane gas to flow into the pipe and for enabling grout to flow out of the pipe. The openings may be sized and spaced along the pipes to enable methane gas entry and grout exit along the length of the pipe without significantly impairing the strength of the pipe. More particularly, the combination gas production liner and degas hole grout sealer may include a plurality of pipe sections with each including means defining mating threads on opposite ends of each pipe section for enabling individual pipe sections to be coupled to one another so that adjacent outside services of pipe sections are flush with one another. This flush exterior surface enables and facilitates the removal of the drill pipe and casing shoe thereover after the casing shoe, drill pipe and liner have been inserted into the degas hole.

BRIEF DESCRIPTION OF THE DRAWINGS

The advantages and features of the present invention will appear from the following description when considered in conjunction with the accompanying drawings in which.

DETAILED DESCRIPTION

Figure 1A:
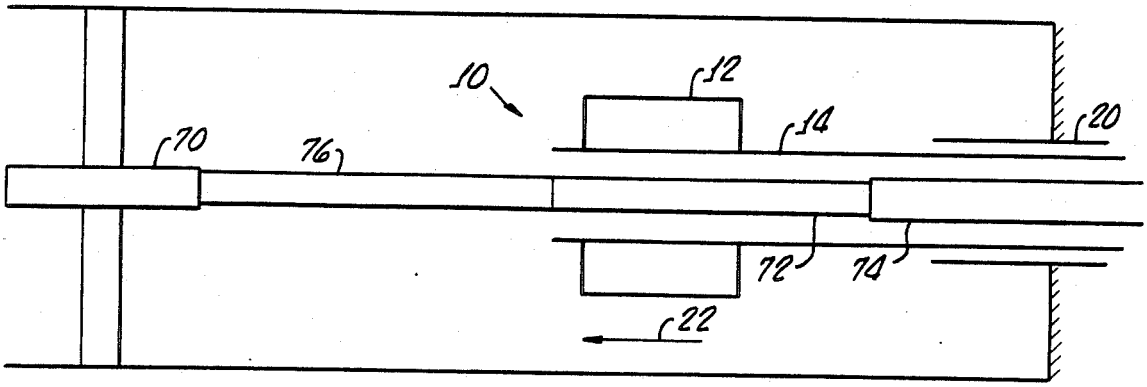
FIGS. 1A, B and C are diagrams of apparatus and steps for inserting and withdrawing a perforated liner into a degas hole.
Figure 1B:
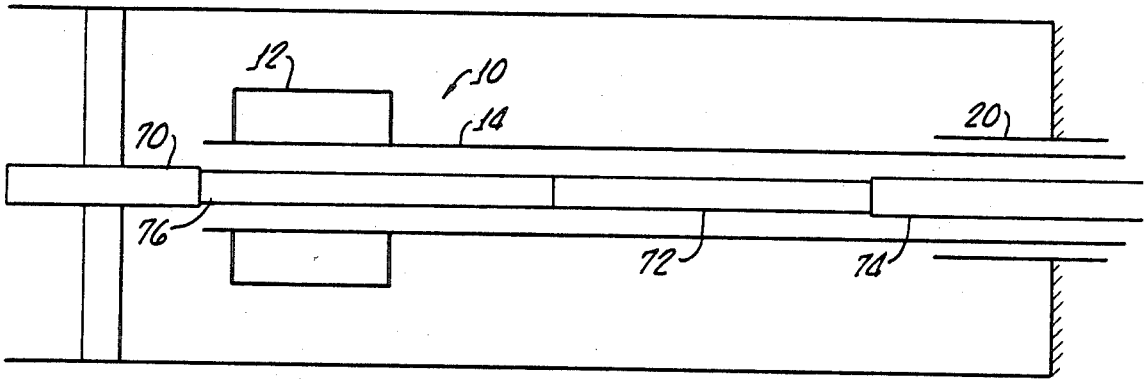
Figure 1C:
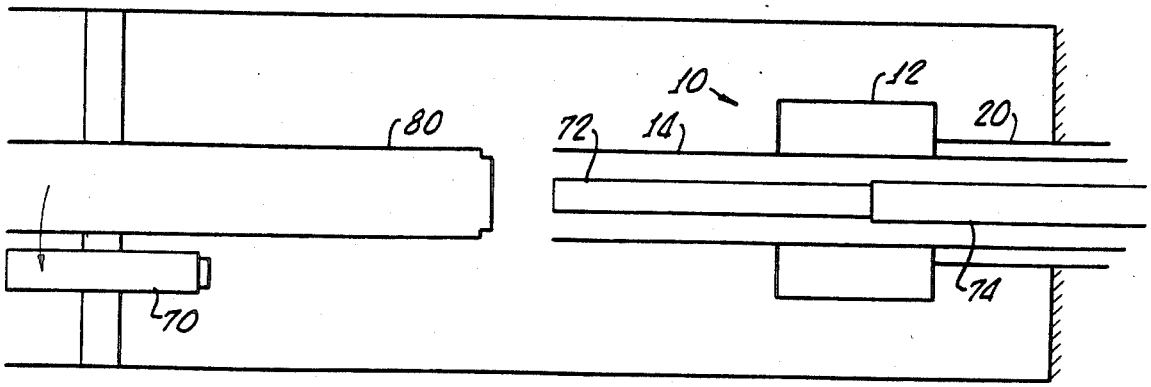

Turning now to FIG. 1A, 1B and 1C, there is shown apparatus 10 useful in practicing the process of the present invention which generally includes a movable drill 12, drill pipe 14 and a conventional drill bit, not shown.

The drill 12 is utilized to drill a pilot hole to a depth of about 40 feet horizontally, or more, as required by the installation of a standpipe 20. A survey of the pilot hole is taken with a single shot survey instrument to ensure the accuracy of the path, and thereafter the pilot string is withdrawn and replaced with a reamer/hole opener assembly, not shown, which is then used to open the hole to a size sufficient to insert the standpipe 20.

After installation of the standpipe 20, drilling is commenced and sections of drill pipe 14 are added by moving the drill 12 in a direction 22 away from the standpipe to enable additional drill pipe sections to be added to one another in a conventional manner.

Figure 2:
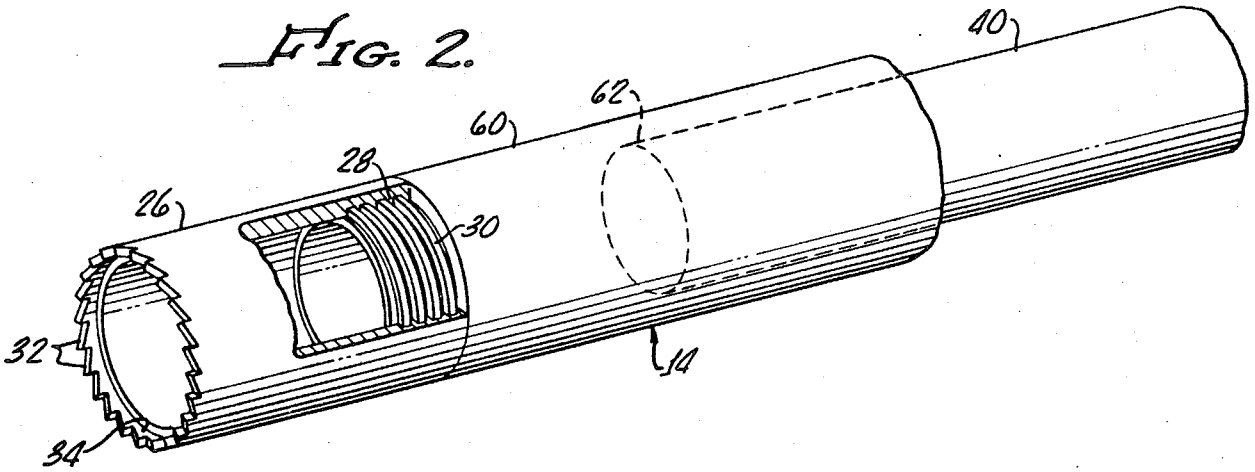
FIG. 2 is a perspective view of the special casing shoe attached to drill pipe for use with the process of the present invention.

Following the completion of the drilling, the drill pipe 14 is withdrawn from the degas hole and a casing shoe 26 (FIG. 2) is attached to the drill pipe 14 by means of threads 28, 30 on the casing shoe 26 and drill pipe 14, respectively.

The casing shoe 26 is especially adapted for use with the process of the present invention and that its outside diameter is the same as the outside diameter of the drill pipe 14. The casing shoe 26 is provided with a set of teeth 32 which project outside from the diameter of the casings shoe 26 about $\frac{1}{4}$ inch. However, the inside edge 34 of the casing shoe 26 proximate the teeth 32 is smooth to enable the shoe 26 to be slid over a liner 40 without damage thereto.

The teeth 32, which may be of any suitable type, such as carbide, and configured for cutting with a clockwise rotation of the drill pipe.

The liner 40, used in the proces of the present invention, may be formed of 2 inch, or any other suitable size, plastic PVC pipe 94, preferably of heavy wall construction, such as schedule 80 PVC pipe.

Figure 3:
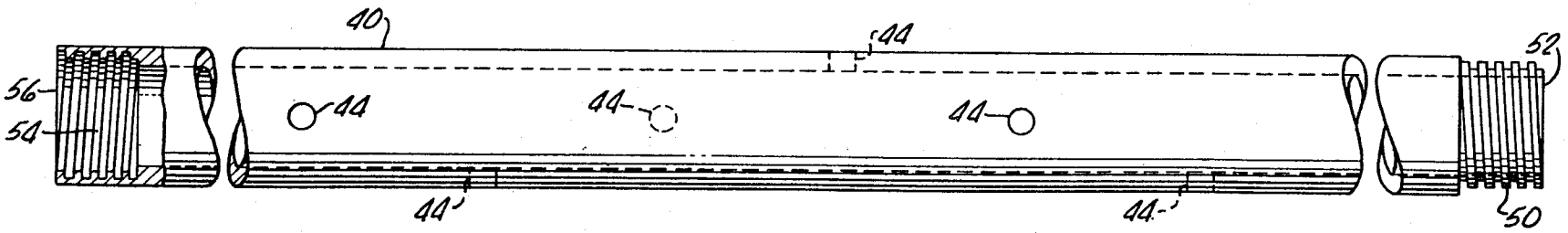
FIG. 3 is a plan view of a section of a perforated liner useful in the process of the present invention, showing threaded end portions thereon for coupling sections to one another.

As shown in FIG. 3, holes 44, which may have a diameter of between about 7/16 of an inch and about 9/16 of an inch, are drilled along each liner section 40, with spacing of approximately 6 inches therebetween. In addition, the holes 44 are rotated 90 degrees with respect to one another along the length of the liner section 40, as illustrated in FIG. 3.

In order to provide a flush outside surface for the liner 40, which is preferably made in 10-foot sections, external threads 50 formed on one end 52 of each pipe section 40 are sized and designed for engaging internal threads 54 on another end 56 of each liner section 40.

The process of the present invention enables the relatively weak and flexible plastic liner 40 to be inserted into horizontal degas holes drilled to lengths of several thousand feet or more. Because such degas holes are drilled within a coal seam and the coal seam follows an undulating pact, the degas hole must necessarily bend upward and downward to remain within the coal seam. The bends within the degas hole make it difficult for the insertion of long lengths of liner, the liner binding in the turns if it inserted by itself. Additionally, sloughing of the wall, or caving of the wall, during the retraction of the drill bit and drill pipe, provides obstacles in the borehole, past which the liner must be pushed.

Following drilling, the borehole may be flushed with water to remove cuttings and debris from the hole. After flushing, the drill pipe 40 is withdrawn from the degas hole and the drill bit (not shown) is replaced with the casing shoe 26, and the drill pipe partially inserted into the degas hole.

The liner 40 is inserted into the drill pipe 14 and thereafter the drill pipe 14 and the liner 40 are inserted into the borehole with a forward portion 60 of the drill pipe 40 inserted into the borehole in advance of a forward portion 62 of the liner 40. In this manner, a liner forward portion 62 is protected and does not physically contact any cutting or debris within the degas hole.

During insertion, if the degas hole is obstructed with debris, the drill pipe 14 and the casing shoe 26 along with the liner 40 therein is rotated in order to cause the teeth 30 to clear a pathway for the drill pipe 14 and enclosed liner 40.

After such rotation, the insertion of the casing shoe 26, drill pipe 14 and liner 40 stop during which time the degas hole is flushed with water to remove any cuttings or debris.

After the liner 40 has been inserted to substantially the entire length of the degas hole, the drill pipe 14 and casing shoe 26 are withdrawn over the liner 40 while the liner is held in place in a procedure shown in FIGS. 1A, B and C.

An air cylinder 70 may be rotatably mounted in a conventional manner to enable its alignment with the standpipe 20, as shown in FIGS. 1A and B, and rotated to a position which is removed from alignment with the standpipe 20, as shown in FIG. 1C, the latter position enabling the drill-pipe 14 to be uncoupled from one another.

In this procedure, an extension bar 72 is screwed onto a last liner section 74 and abutted by a piston 76 extending from the air cylinder 70 when it is actuated. In this manner, the plastic liner 40 is held into the borehole and standpipe 26 as the drill head 12 is moved in the direction of arrow 22 to withdraw the drill pipe 14 from the degas hole and standpipe 20, as shown in FIG. 1B.

Subsequent to withdrawing a 10-foot section of drill pipe 14, the drill head 12 is moved to a position proximate the standpipe 20 and the piston 76 is withdrawn into the air cylinder 70 which is then rotated to enable a drill pipe section 80 to be unscrewed and removed from the drill pipe 14. This procedure is repeated until all of the drill pipe 14 is removed from the hole. As this occurs, the drill pipe 14 passes over the liner 40, as does the casing shoe 26. No damage occurs to the relatively soft plastic liner 40 as this process continues because of the smooth interior surface of the drill pipe 14 and smooth exterior edge 32 of the casing shoe 26.

Following the complete removal of the drill pipe 14 and casing shoe 26, the liner 40 may be flushed with water to ensure a clear path therethrough. Thereafter, methane gas is removed from the liner as it passes through the holes 94.

As mining is anticipated to intercept the degas hole, the liner 40 is utilized to fill the degas hole with grout. In this process, grout is pumped through the liner 40 to fill the end of the degas hole with grout until the end of the liner is filled with grout. Thereafter, the pressure of the grout being pumped through the liner is increased to force grout through the holes 94 in the liner to fill the degas hole along the entire length thereof.

Grout is continually pumped down the liner until the entire degas hole is filled with grout. Since the liner has maintained a clear path through the degas hole despite any sloughing which may occur on the outside thereof, grout can be effectively introduced throughout the entire length of the degas hole and thereby completely filling the degas hole and the liner with grout. When this occurs, the grout is allowed to set and mining can thereafter intercept the previously opened degas hole without significant release of methane gas into working areas.

Although there has been hereinabove described a specific process and a liner for both the production of methane gas from underground coal seams and the sealing of degas holes for the purpose of illustrating the manner in which the present invention may be used to advantage, it should be appreciated that the invention is not limited thereto. Accordingly, any and all modifications, variations, or equivalent arrangements, which may occur to those skilled in the art, should be considered to be within the scope of the invention as defined in the appended claims.

What is claimed is:

1. A process for recovering methane gas from subterranean coal seams using degas holes and sealing said degas holes after recovery of the methane gas in anticipation of mining of coal from the subterranean coal seam, said process comprising the steps of:

drilling a generally horizontal degas hole into a subterranean coal seam using a drill bit and drill pipe;

withdrawing the drill bit and drill pipe and thereafter replacing of the drill bit with a casing shoe;

inserting the casing shoe and drill pipe into the degas hole;

inserting the perforated liner into the borehole through the drill pipe; and, removing the drill pipe and casing shoe while holding the perforated liner within the degas hole, said casing shoe passing on the outside of said perforated liner as it is removed;

collecting methane gas from said perforated liner, said methane gas entering the perforated liner through the perforations therein;

thereafter pumping grout down the center of the perforated liner to the end of the degas hole;

filling the end of the degas hole with grout until the end of the liner is filled with grout;

increasing the pressure of the grout within the liner to force grout through the perforations in the liner to fill the degas hole along the length thereof;

continuing to pump grout down the center of the perforated liner until the entire degas hole is filled with grout; and, allowing the grout to set, thereby sealing the degas hole.

2. The process according to claim 1 wherein the casing shoe, drill pipe and liner therein are inserted simultaneously into the borehole.

3. The process according to claim 2 wherein the borehole is flushed with water as the casing shoe, drill pipe and liner therein are inserted into the borehole.

4. The process according to claim 3 wherein the insertion of the casing shoe, drill pipe and liner therein is stopped during the time the borehole is flushed with water.

5. The process according to claim 2 wherein the casing shoe and a portion of the drill pipe is inserted in the borehole in advance of the liner.

6. The process according to claim 5 wherein the casing shoe and drill pipe with the liner therein are rotated as the casing shoe, drill pipe and liner therein are inserted into the borehole as necessary to overcome obstructions therein.

* * * * *